US006430021B1

(12) United States Patent
Tokunaga

(10) Patent No.: US 6,430,021 B1
(45) Date of Patent: Aug. 6, 2002

(54) CURRENT CONTROLLER FOR CONTACT AND A CONTROLLING METHOD FOR CONTACT

(75) Inventor: Yuichi Tokunaga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/532,019

(22) Filed: Mar. 21, 2000

(30) Foreign Application Priority Data

Sep. 10, 1999 (JP) ..... 11-257088

(51) Int. Cl.[7] ..... H01H 47/00
(52) U.S. Cl. ..... 361/160
(58) Field of Search ..... 200/2, 1, 204; 361/160; 307/132, 137

(56) References Cited

U.S. PATENT DOCUMENTS 5,185,686 A * 2/1993 Hansen ..... 361/93.6
5,672,919 A * 9/1997 Johnson et al. ..... 307/137

OTHER PUBLICATIONS

Unexamined Japanese Patent Publication No. SHO 63–237319; published on Oct. 3, 1988 (Translation only).
Japanese Abstract: JP1–221817A, Sep. 5, 1989.
Japanese Abstract: JP63–276845A, Nov. 15, 1988.

* cited by examiner

*Primary Examiner*—Edward H. Tso
*Assistant Examiner*—Pia Tibbits

(57) ABSTRACT

A current controller for controlling a current supplied to a contact having an external power supply, includes a contact monitoring unit for monitoring the opening and the closing of the contact, a logical computing unit for analyzing a transition of the contact based on the monitoring result from the contact monitoring unit, and a short-circuit unit for short-circuiting the input route based on a direction from the logical computing unit. The logical computing unit turns on the short-circuit unit when the logical computing unit detects chattering at the opening of the contact, and turns off the short-circuit unit after the chattering ends at the closing of the contact.

20 Claims, 10 Drawing Sheets

CURRENT CONTROLLER FOR CONTACT AND A CONTROLLING METHOD FOR CONTACT

BACKGROUND OF THE INVENTION

1. Field of the Invention

The present invention relates to a controller and a method for controlling a current supplied to a contact in a circuit, in order to make the contact have a better electrical contact by means of removing a contact obstacle, such as an insulation coating on the contact.

2. Description of the Related Art

In a detection circuit which informs the output side of a state transition based on a current change through a switch opening/closing, an obstacle such as an insulation coating on a contact lowers the conductivity of the contact. Conventionally, in order to solve this problem, a large current is supplied to the contact so as to remove the obstacle, by using a discharging arc. However, if the large current necessary for the arc is always supplied, a load will be heated, which makes it impossible to reduce the device size.

FIG. 10 shows a conventional current controller for switch contact, used for a safety switch of an elevator and the like, disclosed in Japanese Unexamined Patent Publication HEI 1-221817. According to this, an opening or a closing of the contact is detected. A simulated load is connected to the device. The simulated load causes an arc current to flow for a specific period of time after the detection of the contact closing in order to clean the contact.

In FIG. 10, when a contact 1 of the switch is open, a photo-coupler 113 is in an "off" state because no charge is supplied from a resistance 114. A transistor 110, acts as a switching unit, and is in the "on" state because resistors 111, 112 and 117 are connected to the power supply. However, when contact 1 is open, no charge is supplied to a resistor 109 that functions as a simulated load. Additionally, photo-coupler 103 of the load circuit is "off", and the brake is in the braked state since no charge is supplied to a break-coil 106.

Then, when contact 1 of the switch is closed, contact 1 starts chattering. A current needed for discharging arc is steadily supplied to contact 1 through the resistance 109 and the on-state transistor 110. Therefore, contact 1 is cleaned in order to maintain the contact reliability.

Upon contact 1 being closed, a trigger current is supplied to the photo-coupler 113 through the resistance 114, so that the photo-coupler 113 is turned on. Then, the trigger current for the transistor 110 is bypassed through a resistance 116. Capacitor 115 discharges after a delay time that is controlled by the relation between the capacitor 115 and the resistance 116. During the discharge time, the transistor 110 does not instantly turn off, and becomes "off" after a specific period of time. At this time, the current supplied to contact 1 is small. The circuit is not is under the influence of the contact closing because the chattering has already finished and contact 1 has already closed.

In the conventional current controller for a switching device, an arc current charged only at the moment of the contact closing cleans the contact. Namely, the arc is not discharged at the time of the contact opening. Therefore, the cleaning time of the contact in the prior art is almost half of the cleaning time when the arc current being always supplied. In addition, if the contact is open for a long time, no charge is conducted at the time of the contact closing because an oxide coating and the like forms on the contact. Consequently, no arc is discharged, which decreases the reliability of the contact.

SUMMARY OF THE INVENTION

One of objects of the present invention is to solve the above-noted problems. Specifically, it is one of the objects to realize a compact-sized and less-power-consuming current controller and a current controlling method cleaning, in which the arc current is supplied at both the contact opening and closing. This method further ensures the same contact reliability as when the arc current is always supplied.

According to one aspect of the present invention, a current controller, for controlling a current supplied to a contact having an external power supply, comprises:

a contact monitoring unit that monitors an opening and a closing of the contact;

a logical computing unit that analyzes a transition of the contact, from open to close or close to open, based on a monitoring result from the contact monitoring unit; and a short-circuit unit for short-circuiting an input route based on a command from the logical computing unit;

wherein the logical computing unit turns on the short-circuit unit when the logical computing unit detects a chattering at the opening of the contact, and turns off the short-circuit unit after the chattering ends at the closing of the contact.

According to another aspect of the current controller of the present invention, the contact monitoring unit, the logical computing unit, and the short-circuit unit are semiconductors.

According to another aspect of the current controller of the present invention, the short-circuit unit is connected in series to an electric charge storing unit.

According to one aspect of the present invention, a current controller, for controlling a current supplied to a contact having an external power supply, comprises:

a switching unit, connected to an input route in series, for generating oscillations by repeating connecting and disconnecting the input route in a high frequency;

a contact monitoring unit for monitoring the oscillations of the switching unit;

a logical computing unit for analyzing a transition of the contact based on a monitoring result from the contact monitoring unit; and a switch control unit, based on a direction from the logical computing unit, for stopping the oscillations of the switching unit when a chattering is detected at an opening of the contact, and for starting the oscillations of the switching unit after the chattering ends at a closing of the contact.

According to another aspect of the current controller of the present invention, the contact monitoring unit comprises a monitoring resistor of a low resistance value, so that a large arc current is supplied to the contact.

According to another aspect of the present invention, the current controller further comprises a measuring unit for measuring a state of the contact in analog, and an analog/digital converting unit for converting an output from the measuring unit into digital and informing the logical computing unit of a converted output.

According to another aspect of the present invention, the current controller further comprises a deterioration detecting unit for detecting a contact deterioration degree and changing a notice based on a contact information from the contact monitoring unit.

According to another aspect of the present invention, the current controller further comprises an alarm unit for warning contact deterioration.

According to another aspect of the present invention, the current controller is for detecting an excitation noise of a contact coil and predicting the opening of the contact.

According to another aspect of the present invention, the current controller is for canceling a process for the opening of the contact, after a specific period of time following the predicting the opening of the contact.

According to one aspect of the present invention, a current controlling method, for controlling a current supplied to a contact having an external power supply, comprises:

monitoring an opening and a closing of the contact;

analyzing a transition of the contact based on a monitoring result after the monitoring; and short-circuiting an input route based on a direction by the analyzing;

wherein the short-circuiting is started when a chattering at the opening of the contact is detected in the analyzing, and the short-circuiting is stopped after the chattering ends at the closing of the contact.

According to one aspect of the present invention, a current controlling method, for controlling a current supplied to a contact having an external power supply, comprises:

generating oscillations by repeatedly connecting and disconnecting an input route at a high frequency;

monitoring the oscillations;

analyzing a transition of the contact from open to close or close to open based on a monitoring result from the monitoring of the contact;

stopping the oscillations when a chattering at an opening of the contact is detecting in the analyzing step, based on a command generated from the analyzing step; and starting the oscillations after the chattering ends at a closing of the contact, based on the command generated from the analyzing step.

The above-mentioned and other objects, features, and advantages of the present invention will be made more apparent by reference to the following detailed description when taken in conjunction with the accompanying drawings.

DETAILED DESCRIPTION OF THE PREFERRED EMBODIMENTS

Embodiment 1.

Figure 1:
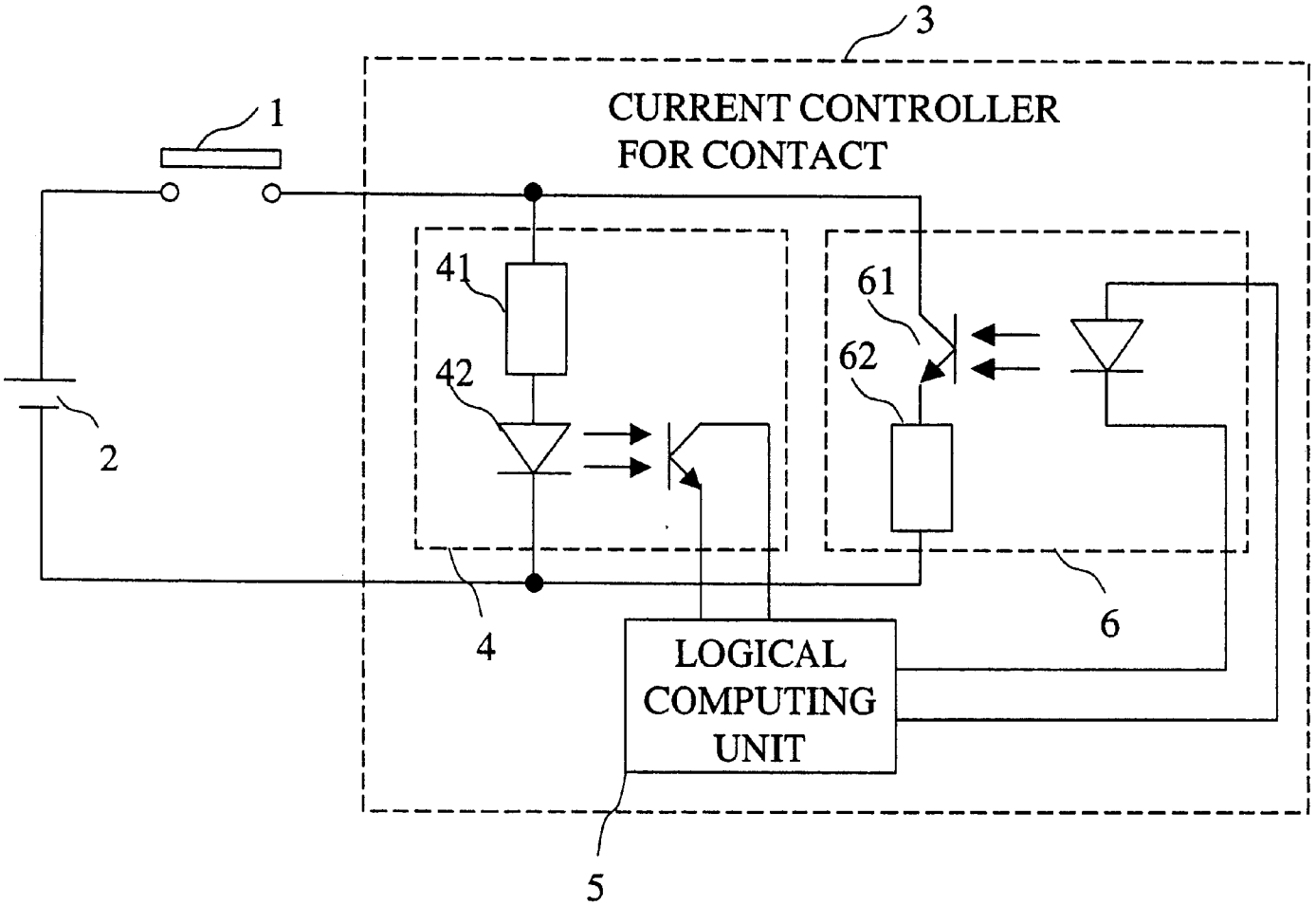
FIG. 1 shows a configuration of a current controller according to Embodiment 1.
Figure 2:
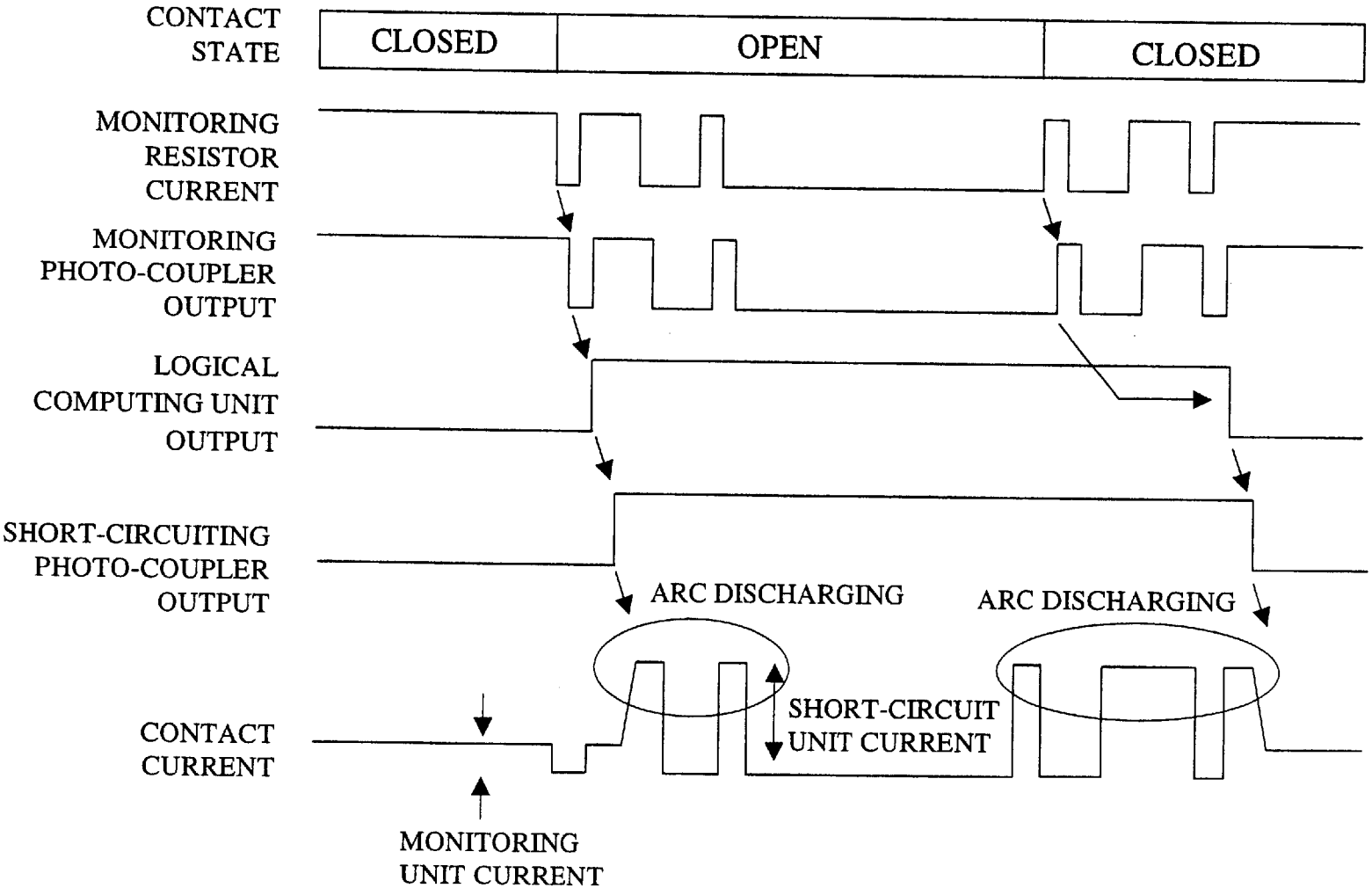
FIG. 2 is a timing chart showing each unit operation corresponding to a contact state, of Embodiment 1.

Embodiment 1 will now be explained with reference to FIGS. 1 and 2. FIG. 1 shows a configuration of a current controller, and FIG. 2 is a timing chart showing each unit operation corresponding to a contact state.

The followings are shown in FIG. 1: a contact 1, a power supply 2 connected to contact 1 in series, a current controller 3 for controlling a current supplied to contact 1, a contact monitoring unit 4 connected between contact 1 and the power supply 2, a monitoring resistor 41 for charging a monitoring current in the contact monitoring unit 4, a monitoring photo-coupler 42 operated by the monitoring current, a logical computing unit 5 for judging the contact opening or closing based on an output from the monitoring photo-coupler 42, a short-circuit unit 6 for short-circuiting a connection between contact 1 and the power supply 2 based on a direction from the logical computing unit 5, a short-circuiting photo-coupler 61 in the short-circuit unit 6, and a short-circuit resistor 62 in the short-circuit unit 6.

Operations will now be explained. As shown in FIG. 2, when contact 1 is closed, the short-circuiting photo-coupler 61 is "off" and no current is supplied to the short-circuit resistor 62, but a current is supplied to the monitoring resistor 41 and the monitoring photo-coupler 42. Since a resistance value of the monitoring resistor 41 is large, only a current necessary for operating the monitoring photo-coupler 42 is supplied to the monitoring photo-coupler 42. The monitoring photo-coupler 42 becomes "on" to inform the logical computing unit 5 that contact 1 is closed.

When contact 1 begins to open, a current supplied to contact 1 starts chattering, so that the monitoring photo-coupler 42 repeats "on" and "off". The logical computing unit 5 is informed of this on-and-off state of the monitoring photo-coupler 42. According to the repetition of "on" and "off" state of the monitoring photo-coupler 42, the logical computing unit 5 detects that contact 1 is beginning to open, and the logical computing unit 5 sends an on-signal to the short-circuiting photo-coupler 61 to turn the short-circuiting photo-coupler 61 "on". Then, a large current needed for discharging arc at contact 1 is supplied to the short-circuit resistor 62 of a low resistance value.

The duration of the chattering at contact 1 is usually some milliseconds to tens of milliseconds. On the other hand, as the monitoring photo-coupler 42, the short-circuiting photo-coupler 61 and the logical computing unit 5 are all semiconductors, they can react in the order of microseconds. Therefore, even if the delay between the start of chattering on contact 1 and the turning "on" of the short-circuiting photo-coupler 61 is taken into the consideration, the operations of the monitoring photo-coupler 42, the short-circuiting photo-coupler 61 and the logical computing unit 5 start within the chattering period. Accordingly, the arc is discharged at contact 1 within the chattering period to clean contact 1.

When contact 1 has completely opened, the short-circuiting photo-coupler 61 still remains "on" as shown in FIG. 2, even though no charge is supplied to the contact monitoring unit 4 and the short-circuit unit 6.

Then, as contact 1 begins to close again, current is supplied to the short-circuit unit 6 during the chattering, so that the arc is discharged at contact 1 to clean contact 1. The monitoring photo-coupler 42 turns "on" again, so that the logical computing unit 5 detects that contact 1 is closed and turns off the short-circuiting photo-coupler 61 after the chattering ends. Then, at the time of the chattering end, the short-circuit unit 6 is turned off. Therefore, only a small current from the monitoring resistor 41 is supplied to contact 1.

As stated above, since the arc is discharged at both the occasions of the contact opening and closing, it is possible to maintain the same reliability of contact 1 as the case of the short-circuit current being always supplied.

In addition, the large current that is needed for the arc discharge is required only during the chaffering at the contact opening and closing. A small current is usually supplied during non-switching times, which allows for a compact-sized and less-power-consuming current controller.

A current controlling method can also be realized by performing the same operations as described above.

Embodiment 2.

In Embodiment 1, the arc current is supplied by means of short-circuiting. In Embodiment 2, the arc current is supplied by utilizing a charge to an electric charge storing unit.

Figure 3:
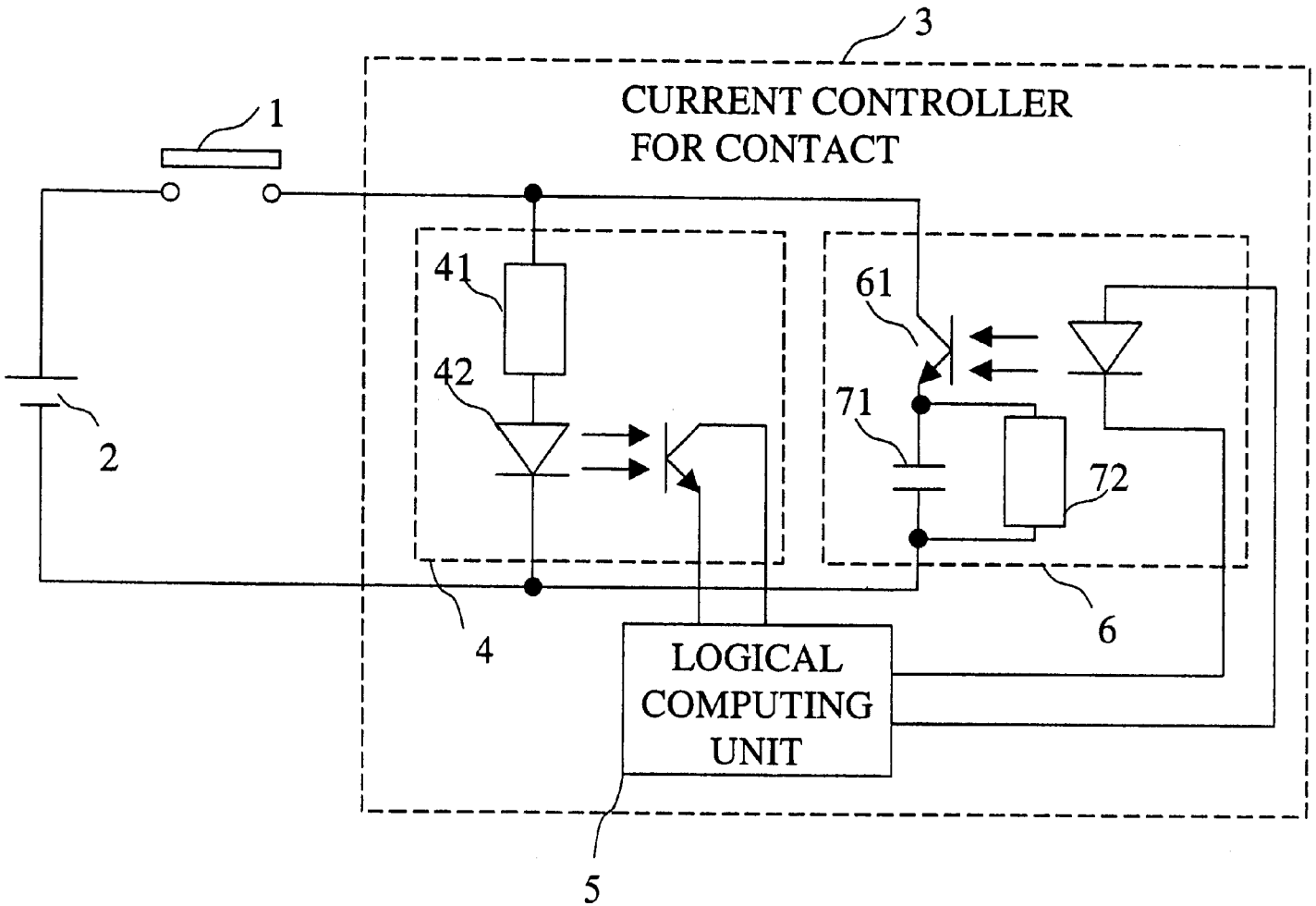
FIG. 3 shows a configuration of a current controller according to Embodiment 2.

FIG. 3 shows a configuration of the current controller according to Embodiment 2. In FIG. 3, a capacitor 71, being an electric charge storing unit, is connected in series to the short-circuiting photo-coupler 61 and a supplemental resistor 72 is connected in parallel to the capacitor 71 as shown.

Now, the operation will be explained. In Embodiment 2, the operations up to detecting the opening of contact 1 by the logical computing unit, and turning on the short-circuiting photo-coupler 61 are the same as those in Embodiment 1. When the short-circuiting photo-coupler 61 is turned on, the capacitor 71 begins to charge. The arc is discharged at contact 1 by the charging current in order to clean contact 1. If contact 1 has completely opened, the capacitor 71 discharges through the supplemental resistor 72. Then, at the time of contact 1 beginning to close, the capacitor 71 starts to charge again, so that the arc is discharged at contact 1. Namely, when the charge of the capacitor 71 is saturated, the capacitor discharges while the short-circuiting photo-coupler 61 turns off and the current flows to the supplemental resistor 72.

As stated above, the arc current is supplied by the charging current of the capacitor 71. Therefore, even if by chance logical computing unit 5 does not operate correctly, the arc current is not continuously supplied. Accordingly, the reliability of the current controller is enhanced.

A current controlling method can also be realized by performing the same operations as described above.

Embodiment 3.

In Embodiments 1 and 2, the current controller, which achieves low power consumption and high contact reliability by controlling current values, is described. In this Embodiment 3, a current is controlled based on a pulse width.

Figure 4:
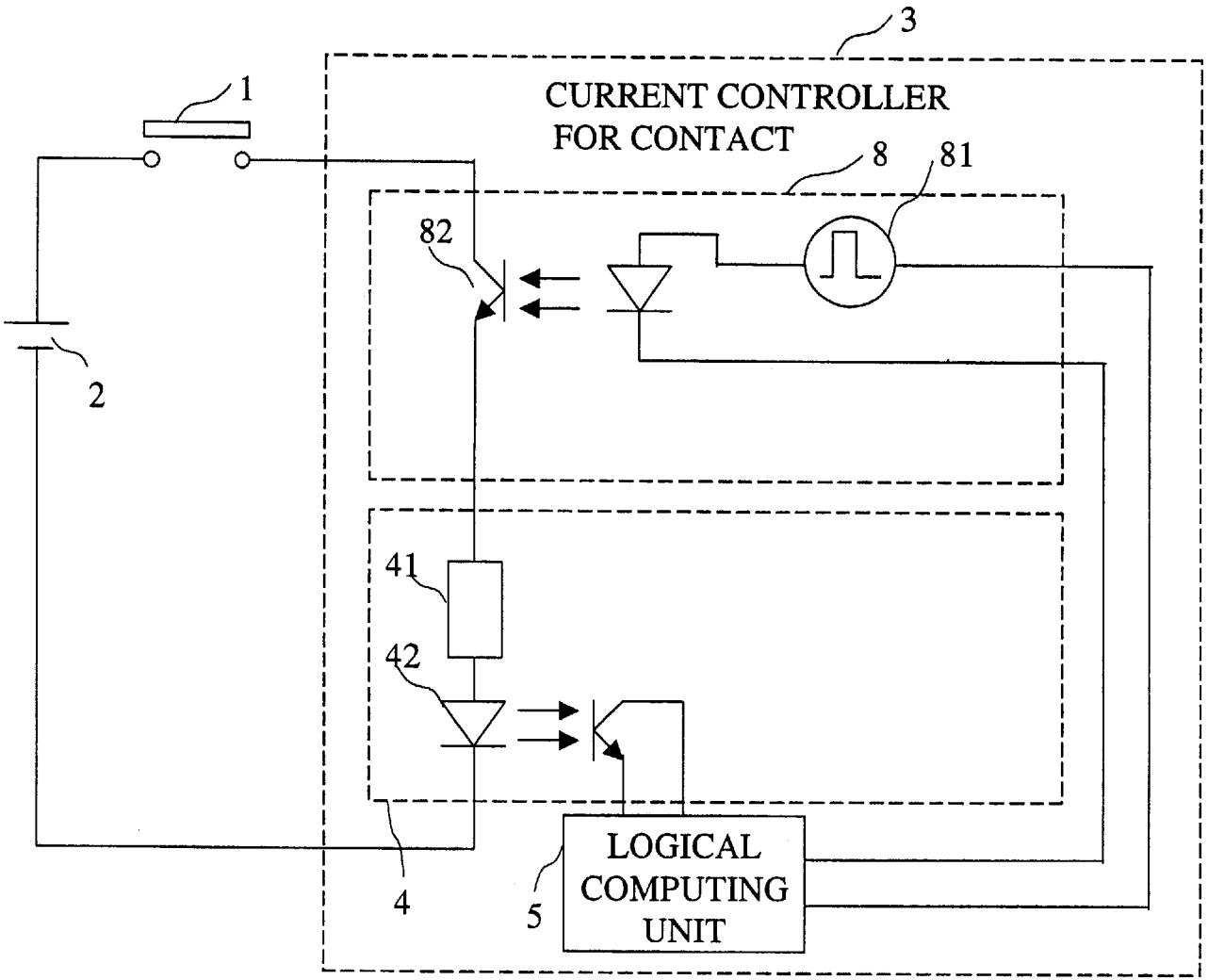
FIG. 4 shows a configuration of a current controller according to Embodiment 3.

Embodiment 3 will now be explained with reference to FIGS. 4 and 5. FIG. 4 shows a configuration of the current controller and FIG. 5 is a timing chart showing each unit operation corresponding to a contact state.

In FIG. 4, a switching unit 8 for turning on or off the current to contact 1, an oscillator 81 for generating periodic pulses in the switching unit 8, and a switching photo-coupler 82 for performing switching in the switching unit 8 are shown.

Now operations will be explained referring to FIG. 5. When contact 1 is closed, the oscillator 81 generates pulses having a shorter pulse width cycle compared to the chattering time. The switching photo-coupler 82 repeats turning "on" and "off" the current supplied to contact 1, that is connecting and disconnecting an input route, based on the pulses from the oscillator 81. The contact monitoring unit 4 is connected in series to the switching unit 8. The monitoring photo-coupler 42 outputs pulses corresponding with the pulse width of the switching unit 8. The resistance value of the monitoring resistor should be small enough that a peak of the current supplied to contact 1 is large enough to be discharged as the arc.

Figure 5:
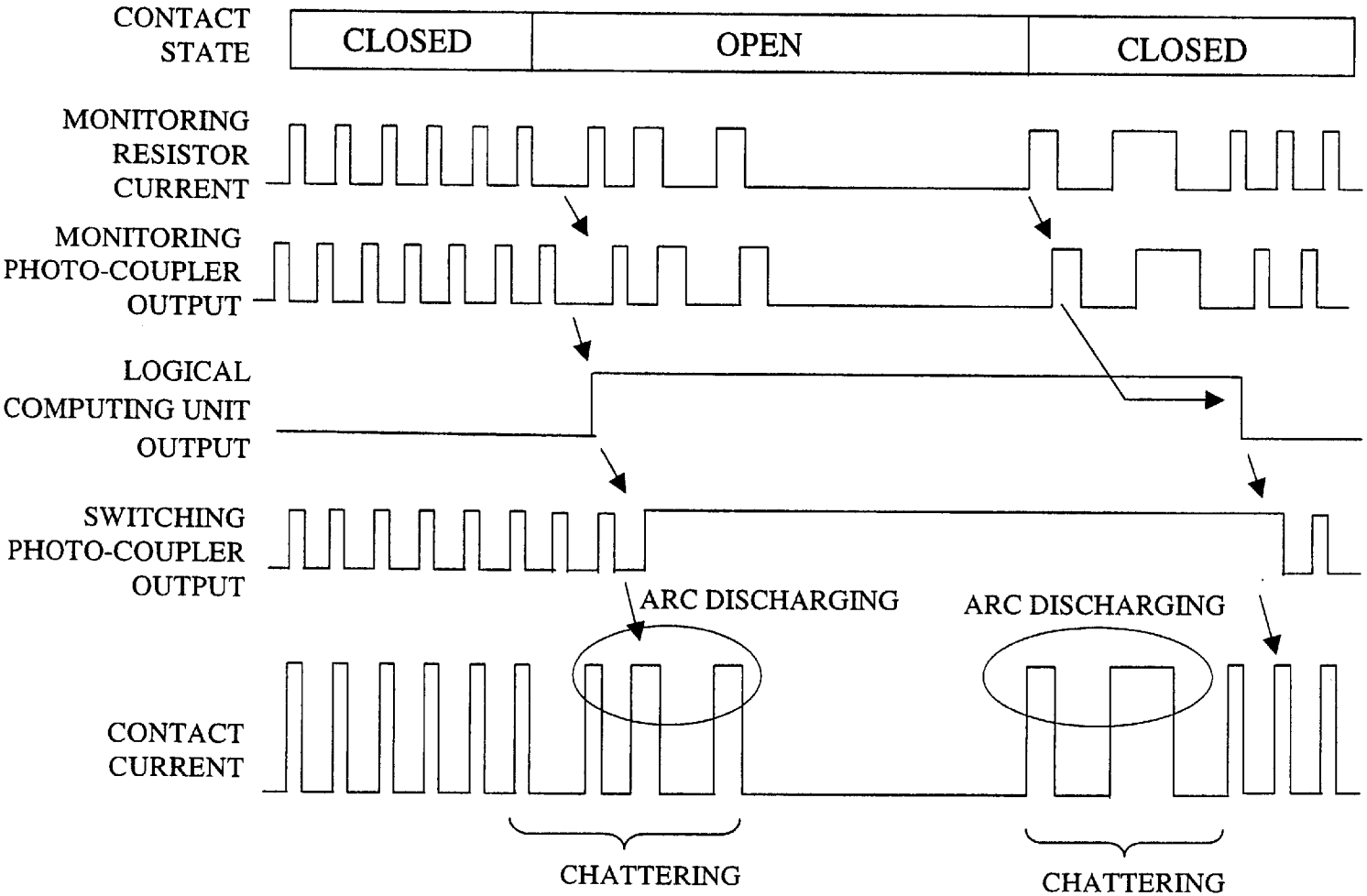
FIG. 5 is a timing chart showing each unit operation corresponding to a contact state, of Embodiment 3.

As shown in FIG. 5, when contact 1 begins to open, the pulses of the monitoring photo-coupler 42 are modulated because of the chattering. Then, the logical computing unit 5 detects the pulse modulation and informs the switching unit 8 of the opening of contact 1. On receiving the information from the logical computing unit 5, the oscillator 81 in the switching unit 8 turns on the switching photo-coupler 82 and stops itself. The switching photo-coupler 82 remains in the on-state. In the meantime, the arc is discharged for a short time by the pulse current having a high peak value. If the arc is discharged once, plasma gas is generated around contact 1, which brings about a state of easily discharging arc. In this state, the pulse of the switching photo-coupler 82 remains "on" and a current is steadily supplied. Then, the arc is discharged at contact 1 for a long time to clean contact 1.

When contact 1 has completely opened, no current is supplied and the pulse of the switching photo-coupler 82 still remains "on" without generating pulses. If contact 1 begins to close, a current is supplied to contact 1 again and the arc is discharged during closing, as is the case of the contact opening. The monitoring photo-coupler 42 turns "on". The logical computing unit 5 detects the "on" and informs the switching unit 8 that contact 1 begins to close. The oscillator 81 begins to oscillate again and the switching photo-coupler 82 repeats the "on" and "off" cycles. Accordingly, the current supplied to contact 1 is pulsed again.

As stated above, practical power consumption is reduced by pulsing the current supplied to contact 1. In addition, when the opening of contact 1 is detected, the arc needed for cleaning contact 1 can be discharged by changing the pulsed current into a steady current. Furthermore, after detection of the contact opening, the arc becomes easy to be discharged by the plasma gas generated by a short time arc discharging based on the pulses before the detection of the contact opening.

A current controlling method can also be realized by performing the same operations as described above.

Embodiment 4.

In the above Embodiments, the logical computing unit 5 inputs two values representing "on" and "off", from the contact monitoring unit 4. In this Embodiment 4, the logical computing unit 5 inputs analog values.

Figure 6:
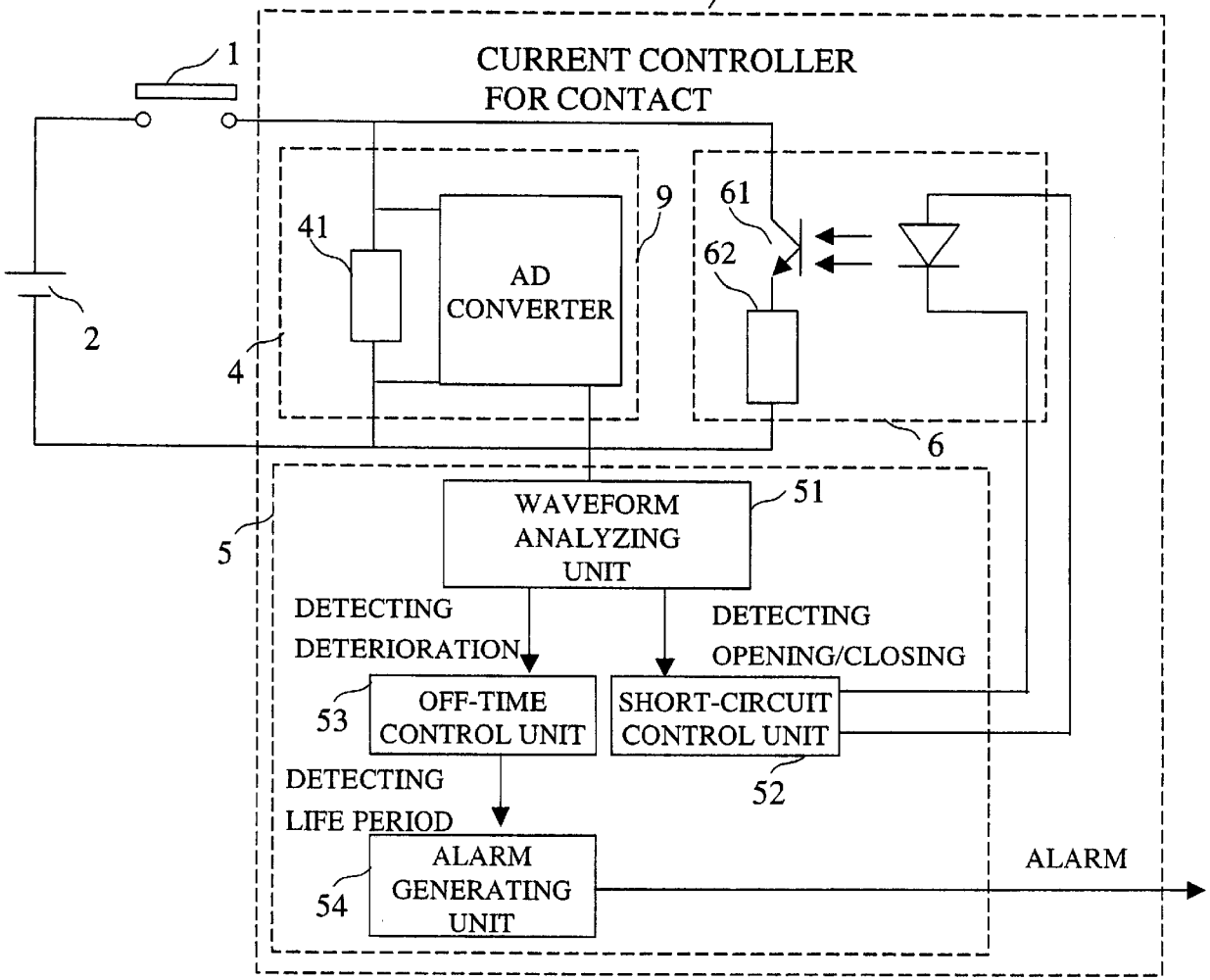
FIG. 6 shows a configuration of a current controller according to Embodiment 4.
Figure 7:
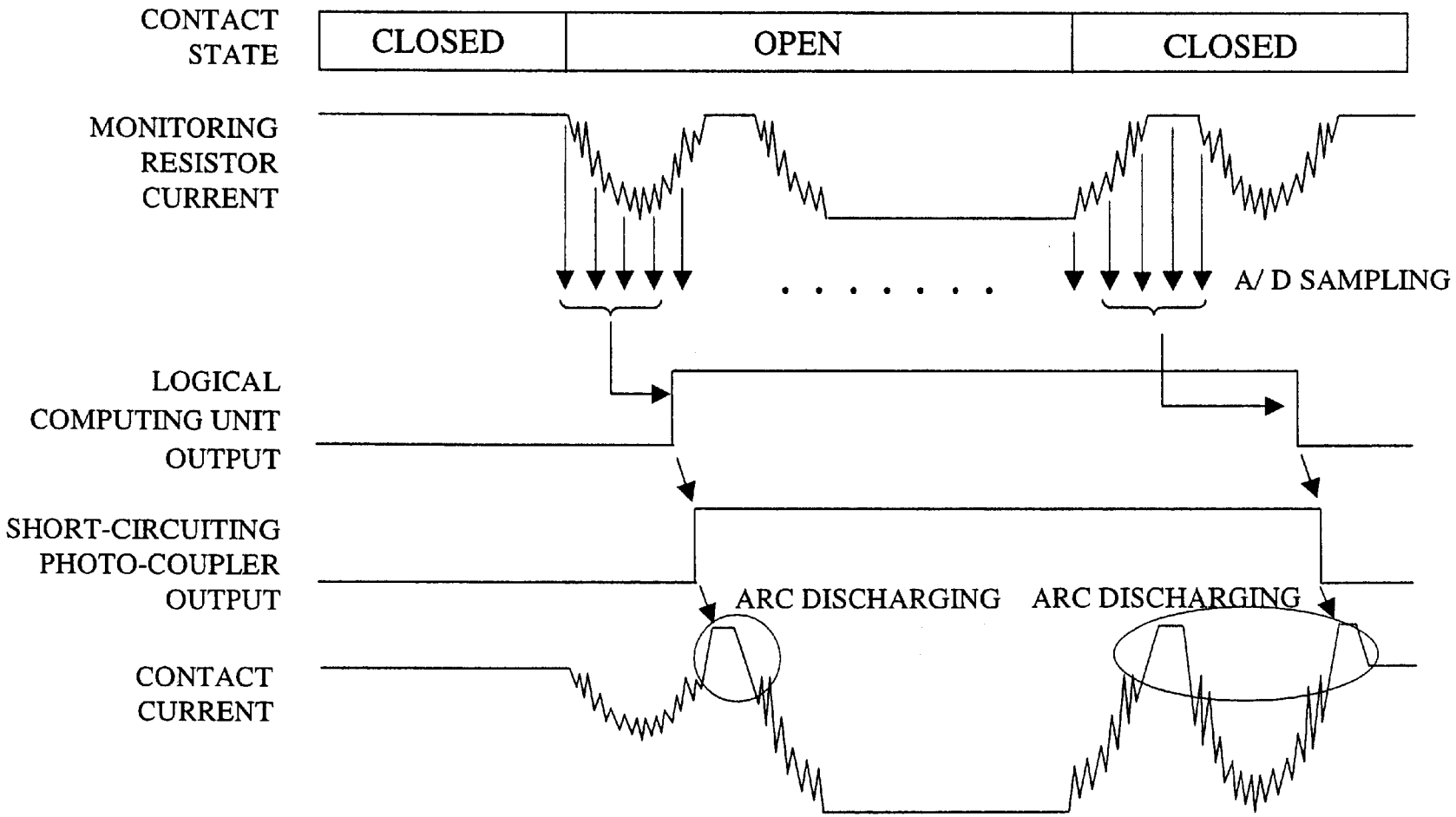
FIG. 7 is a timing chart showing contact current controlling operations of Embodiment 4.
Figure 8:
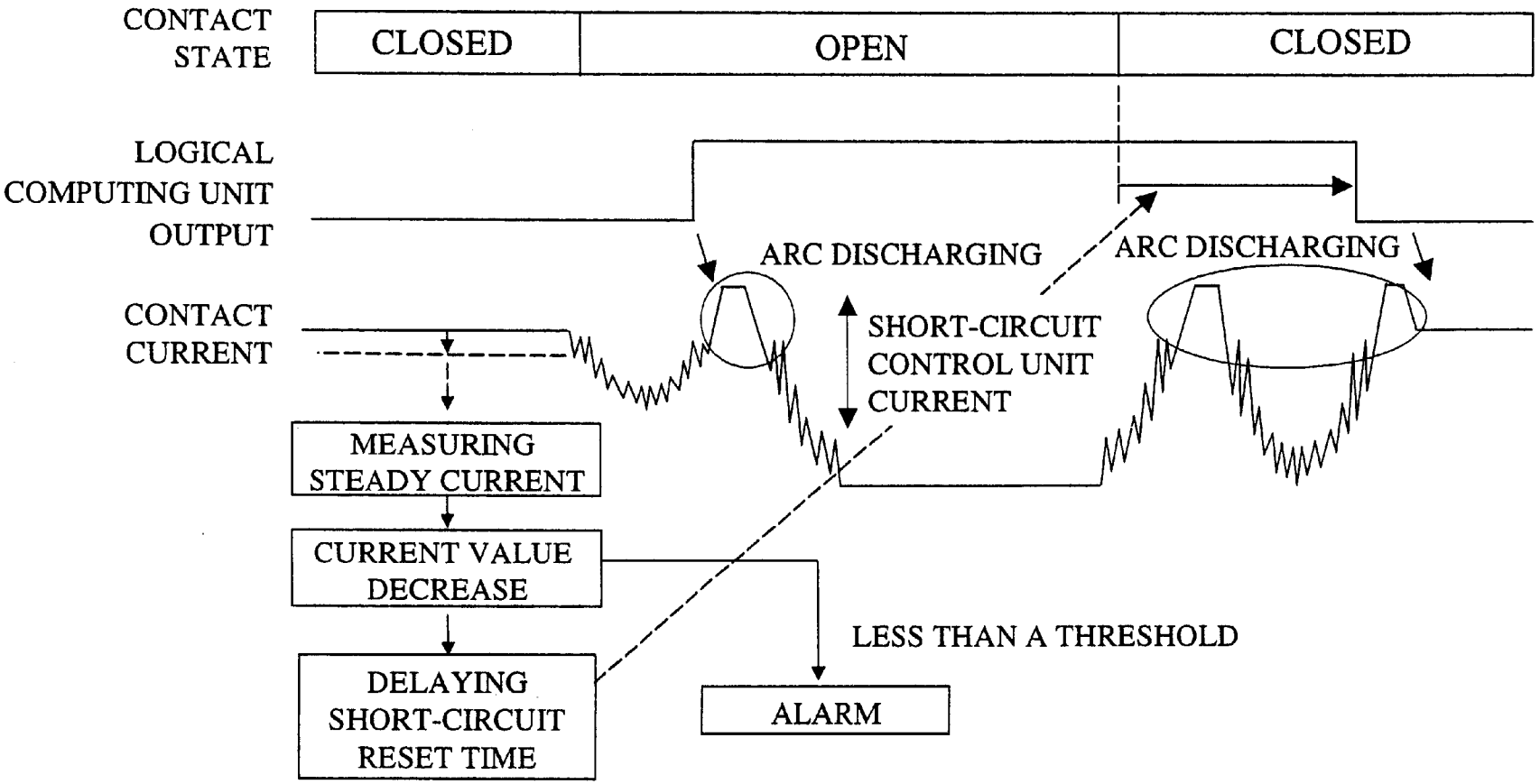
FIG. 8 is a timing chart showing operations for controlling contact deterioration of Embodiment 4.

Embodiment 4 will now be explained with reference to FIGS. 6, 7 and 8. FIG. 6 shows a configuration of the current controller, FIG. 7 is a timing chart showing contact current controlling operations, and FIG. 8 is a timing chart showing operations for controlling contact deterioration.

In FIG. 6, the followings are shown: an AD converter 9 which measures voltages at both the ends of the monitoring resistor 41, converts the measured analog values into digital values, and informs the logical computing unit 5 of the converted digital values, a waveform analyzing unit 51 for receiving outputs from the AD converter 9 and detecting a state of contact 1, a short-circuit control unit 52 for controlling "on" and "off" of the short-circuiting photo-coupler 61 based on the contact state "on" or "off " detected by the waveform analyzing unit 51, an off-time control unit 53 for controlling off-time of the short-circuiting photo-coupler 61 based on a deterioration degree of contact 1 detected by the waveform analyzing unit 51, and an alarm generating unit 54 for warning that contact 1 is too much deteriorated to work effectively. In this Embodiment, the AD converter 9 substitutes for the monitoring photo-coupler 42 of Embodiment 1. It is also acceptable to substitute the AD converter 9 for the monitoring photo-coupler 42 of Embodiment 2 or 3.

The AD converter 9 frequently monitors voltage values at a cycle shorter than the chattering cycle. The waveform analyzing unit 51 examines data output from the AD converter 9 to analyze a state of contact 1 based on a waveform pattern transition representing the contact state. For instance, the waveform analyzing unit 51 compares a present waveform pattern with a specific waveform pattern, programmed in advance, representing an opening state of contact 1. If the present waveform pattern corresponds with the specific waveform pattern, it is judged that contact 1 is open. Then, the waveform analyzing unit 51 informs the short-circuit control unit 52 of the contact opening in order to turn on the short-circuit photo-coupler 61. As stated above, a state transition of contact 1 can be separated from a noise by analyzing an analog value representing a current supplied to contact 1. In addition, the contact state transition can be detected earlier by means of analyzing analog values.

The contact deterioration can be detected by utilizing analog values. When contact 1 is closed, a steady current is supplied to contact 1. A value of this steady current becomes small in proportion as the conductivity is deteriorated by an oxide coating on contact 1. The smaller an input value from the monitoring unit 4 becomes, the later the off-time control unit 53 turns off the short-circuit photo-coupler 61 in the short-circuit control unit 52. Thus, the period of the arc current being supplied at the contact closing is extended. Therefore, contact 1 is very much cleaned and the reliability of contact 1 is further enhanced.

Besides, in the case of the steady current being decreased, the operator or the computer controlling other computers can be informed of the decrease by the alarm generating unit 54. Then, counter measures such as an exchange of contact 1 can be taken, which prevents the apparatus trouble.

A current controlling method can also be realized by performing the same operations as described above.

Embodiment 5.

In the above Embodiments, configurations in which the current supplied to contact 1 is controlled by using the logical computing unit 5 have been described. In this Embodiment 5, a contact opening detection/control process performed by the logical computing unit 5 will now be explained.

Figure 9:
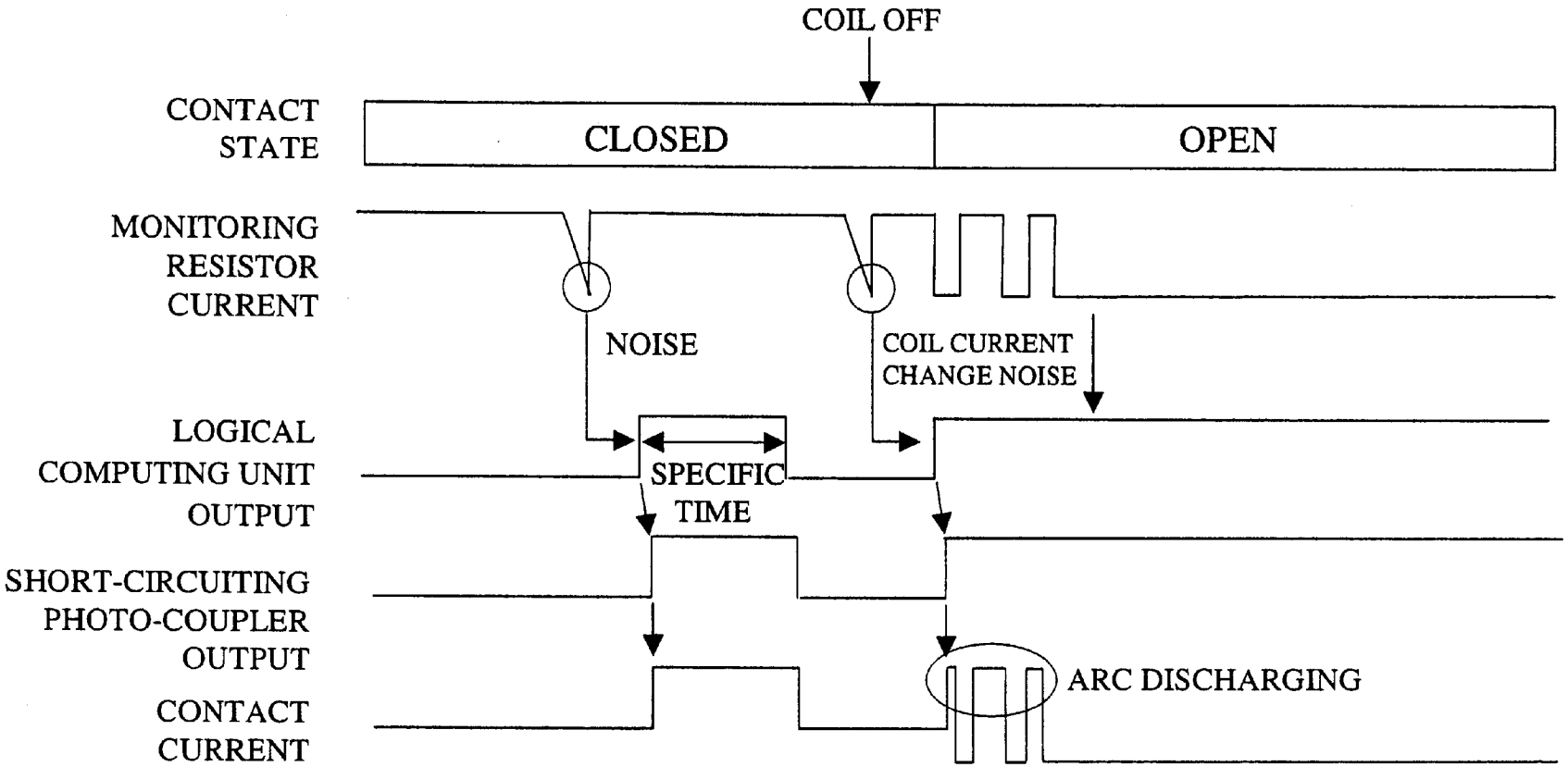
FIG. 9 is a timing chart showing operations of a contact opening prediction of Embodiment 5.
Figure 10:
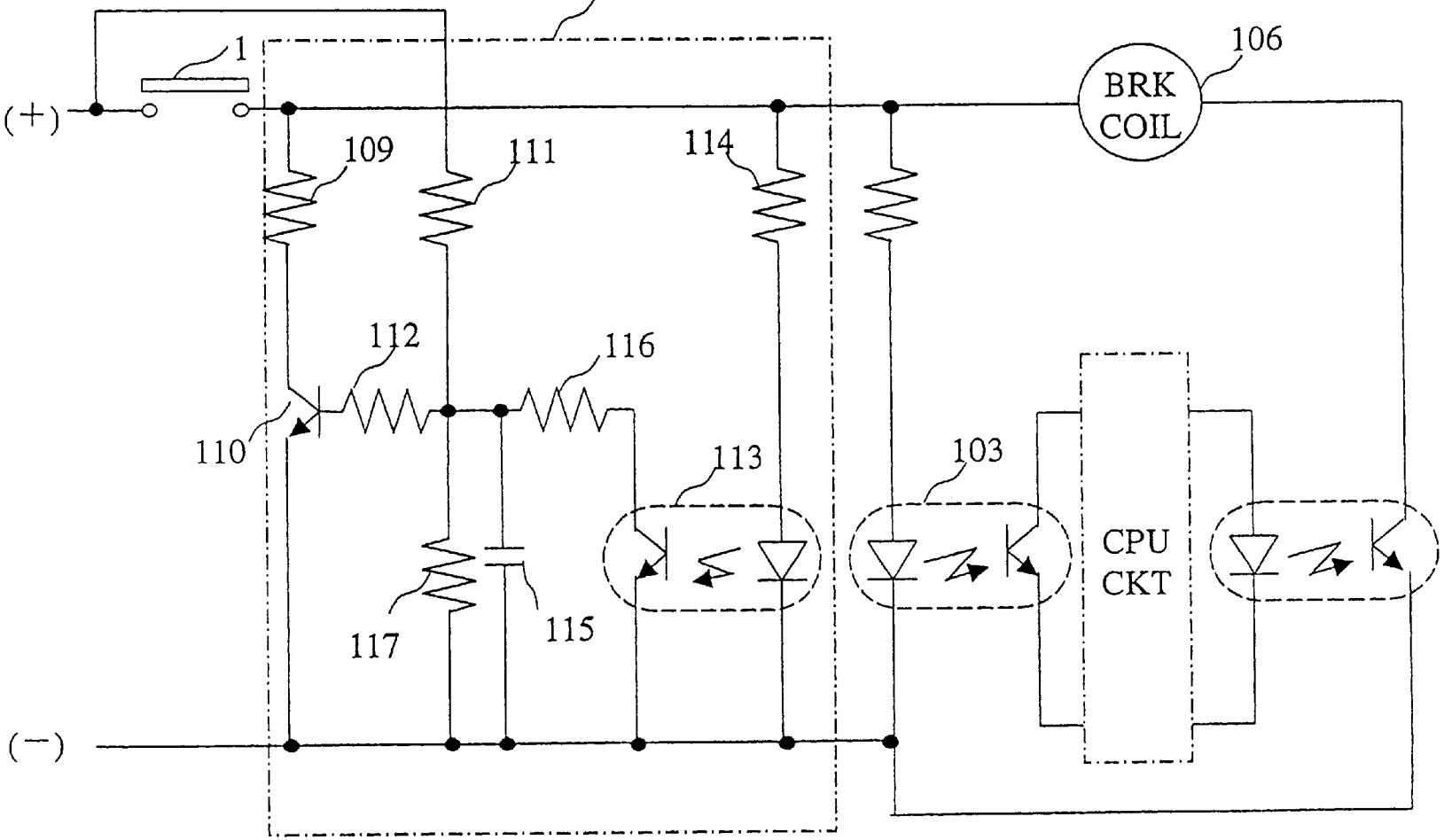
Fig. 10 PRIOR ART
FIG. 10 shows a configuration of a conventional current controller.

The configuration of the current controller is the same as Embodiment 1. Embodiment 5 is now described with reference to FIG. 9 which is a timing chart showing operations of a contact opening prediction. When contact 1 opens or closes, noise is transmitted by the change of a coil current driving contact 1. There is a specific time delay, depending upon a contact characteristic, between the noise and the time when contact 1 practically opens or closes. By this noise, the logical computing unit 5 detects that the monitoring photo-coupler 42 turns "on. Then, the logical computing unit 5 turns on the short-circuiting photo-coupler 61 and allows the arc current to be supplied, so that the arc is discharged at the contact when the contact begins to open after a specific period of time.

If the conditions of contact 1 is bad, noise caused by other reason may be transmitted. In order to prevent false operations caused by this noise, the logical computing unit 5 first turns on the short-circuiting photo-coupler 61 based on the noise detection, and detects the on/off state of the monitoring photo-coupler 42 again after a specific period of time. The specific period of time indicates a time from the coil current change depending upon the contact characteristic to the contact opening. When the noise detected for turning on the short-circuiting photo-coupler 61 is generated by the coil current change, the state of the monitoring photo-coupler 42 after the specific period of time is "off". In this case, the state of the short-circuiting photo-coupler 61 remains "off" until the next detection of the contact closing. In the case of the noise detected for turning on the short-circuiting photo-coupler 61 being generated by other reason, the state of the monitoring photo-coupler 42 after the specific period of time is "on". In this case, the short-circuiting photo-coupler 61 is turned off and the logical computing unit 5 waits for the next noise detection again. Therefore, by the contact being monitored again after a specific period of time following the noise detection, it is possible to prevent the arc current from being supplied continuously. This avoids a false operation caused by noises different from that of the contact driving coil.

Namely, the arc current can be supplied during the specific period of time, depending on the detection of the noise caused by the change of the coil current for driving contact 1. Therefore, enough arc current for discharging the arc is supplied at the time of the contact opening, hence the arc discharging cleans contact 1. The large current necessary for the arc is supplied only just before the contact opening and the current which usually flows is a small current. Accordingly, a compact-sized and less-power-consuming current controller can be realized.

A current controlling method can also be realized by performing the same operations as described above.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only, and not intended to be limiting. The invention is limited only as defined in the following claims and the equivalents thereto.

What is claimed is:

1. A current controller for controlling a current supplied to a contact having an external power supply, comprising:

a contact monitoring unit that monitors an opening and a closing of the contact;

a logical computing unit that analyzes a transition of the contact, from open to close or close to open, based on a monitoring result from the contact monitoring unit; and a short-circuit unit for short-circuiting an input route based on a command from the logical computing unit;

wherein the logical computing unit turns on the short-circuit unit when the logical computing unit detects a chattering at the opening of the contact, and turns off the short-circuit unit after the chattering ends at the closing of the contact.

2. The current controller of claim 1, wherein the contact monitoring unit, the logical computing unit, and the short-circuit unit are semiconductors.

3. The current controller of claim 1, wherein the short-circuit unit is connected in series to an electric charge storing unit.

4. The current controller of claim 1 further comprising a measuring unit that measures a state of the contact in analog, and an analog/digital converting unit for converting an output from the measuring unit into digital and informing the logical computing unit of a converted output.

5. The current controller of claim 4 further comprising a deterioration detecting unit that detects a contact deterioration degree and changes a notice based on a contact information from the contact monitoring unit.

6. The current controller of claim 5 further comprising an alarm unit that warns contact deterioration.

7. The current controller of claim 1, wherein the current controller detects an excitation noise of a contact coil and predicts the opening of the contact.

8. The current controller of claim 7, wherein the current controller cancels a process for the opening of the contact, after a specific period of time following the prediction of the opening of the contact.

9. A current controller for controlling a current supplied to a contact having an external power supply, comprising:

a switching unit, connected in series to an input route that generates oscillations by repeatedly connecting and disconnecting the input route at a high frequency;

a contact monitoring unit for monitoring a pulse current of the switching unit;

a logical computing unit for analyzing a transition of the contact, from open to close or close to open, based on a monitoring result from the contact monitoring unit; and a switch control unit, based on a command from the logical computing unit, that stops the oscillations of the switching unit when a chattering is detected by the logical computing unit at an opening of the contact, and that starts the oscillations of the switching unit after the chattering ends at a closing of the contact.

10. The current controller of claim 9, wherein the contact monitoring unit comprises a monitoring resistor having a low resistance value, so that a large arc current is supplied to the contact.

11. The current controller of claim 9 further comprising a measuring unit that measures a state of the contact in analog, and an analog/digital converting unit for converting an output from the measuring unit into digital and informing the logical computing unit of a converted output.

12. The current controller of claim 11 further comprising a deterioration detecting unit that detects a contact deterioration degree and changes a notice based on a contact information from the contact monitoring unit.

13. The current controller of claim 12 further comprising an alarm unit that warns contact deterioration.

14. The current controller of claim 9 wherein the current controller detects an excitation noise of a contact coil and predicts the opening of the contact.

15. The current controller of claim 14, wherein the current controller cancels a process for the opening of the contact, after a specific period of time following the prediction of the opening of the contact.

16. A current controlling method for controlling a current supplied to a contact having an external power supply, comprising:

monitoring an opening and a closing of the contact;

analyzing a transition of the contact, from open to close or close to open, based on a monitoring result from the monitoring of the contact; and short-circuiting an input route based on a command generated by the analyzing step;

wherein the short-circuiting is started when a chattering at the opening of the contact is detecting in the analyzing step, and the short-circuiting is stopped after the chattering ends at the closing of the contact.

17. The current controller method of claim 16, wherein the short-circuiting further comprises:

connecting the input route to an electric charge storing unit.

18. The current controller method of claim 16, further comprising:

detecting an excitation noise of a contact coil; and predicting the opening of the contact.

19. The current controller method of claim 16, further comprising:

measuring a state of the contact in analog; and converting the analog measurement into a digital value.

20. A current controlling method for controlling a current supplied to a contact having an external power supply, comprising:

generating oscillations by repeatedly connecting and disconnecting an input route at a high frequency;

monitoring the oscillations;

analyzing a transition of the contact from open to close or close to open based on a monitoring result from the monitoring of the contact;

stopping the oscillations when a chattering at an opening of the contact is detecting in the analyzing step, based on a command generated from the analyzing step; and starting the oscillations after the chattering ends at a closing of the contact, based on the command generated from the analyzing step.

* * * * *